US005360118A

United States Patent [19]

Kempf et al.

[11] Patent Number: 5,360,118

[45] Date of Patent: Nov. 1, 1994

[54] PEA SEPARATING PROCESS USING DIATOMACEOUS EARTH

[75] Inventors: Thomas P. Kempf, Brooklyn Park; Dennis B. Usgaard, New Hope, both of Minn.

[73] Assignee: The Pillsbury Company, Minneapolis, Minn.

[21] Appl. No.: 89,262

[22] Filed: Jul. 9, 1993

[51] Int. Cl.[5] ..... B03B 5/30

[52] U.S. Cl. ..... 209/172.5; 209/173

[58] Field of Search ..... 209/172, 172.5, 173; 99/534, 536, 570; 426/481, 478, 507

[56] References Cited

U.S. PATENT DOCUMENTS

| | | | |
|---|---|---|---|
| 2,113,609 | 4/1938 | Wuensch | 209/172.5 |
| 2,620,069 | 12/1952 | Wendt | 209/172.5 |
| 2,775,346 | 12/1956 | Tromp | 209/172.5 |
| 4,063,565 | 12/1977 | Edwards et al. | 209/173 X |
| 4,082,655 | 4/1978 | Toledo | 209/173 |
| 4,111,798 | 9/1978 | Peterson et al. | 209/173 X |
| 4,858,769 | 8/1989 | DeVries | 209/173 X |
| 5,039,534 | 8/1991 | Adams et al. | 426/231 |

*Primary Examiner*—Robert P. Olszewski
*Assistant Examiner*—Boris Milef
*Attorney, Agent, or Firm*—Kinney & Lange

[57] ABSTRACT

The present invention includes a process for separating food particles of different specific gravities. The process includes providing a feedstock of the food particles, providing a feedstock of diatomaceous earth and water having a specific gravity effective for particles to float or sink; adding the slurry and separating the floating food particles from the sinking food particles; dewatering the food particles and collecting the water; extracting the diatomaceous earth from the slurry and re-using the diatomaceous earth in the process.

11 Claims, 1 Drawing Sheet

PEA SEPARATING PROCESS USING DIATOMACEOUS EARTH

BACKGROUND OF THE INVENTION

The present invention relates to a method for separating food pieces in a liquid based upon differences in specific gravity of the food pieces. In particular, the present invention relates to a method for separating young food particles from mature food particles in a liquid based upon the starch content of the food particles.

Sweetness is a primary attribute of peas that is of concern to consumers. Pea sweetness depends upon the sugar content within the pea which is itself a function of pea maturity. A pea matures when sugars initially present within the pea are converted to starch for long term energy storage. In addition to sweetness, the amount of starch within the pea also affects the texture or mouthfeel of the pea. Consumers prefer a tender mouthfeel which translates into a smooth firm texture. As starch concentration increases within the pea, the pea tends to take on a rough texture.

Pea maturity as measured by starch concentration has been measured by a wet chemistry test that determines the percentage of Alcohol Insoluble Solids (AIS) within the pea. As a pea matures, the amount of the alcohol insoluble solids within the pea increases while the amount of alcohol soluble solids decreases. AIS units may be correlated with the percentage of starch within the peas. For example, early peas which are usually high in sugar content have low starch concentrations and therefore have a low AIS percentage, whereas mature peas picked later in the season have high starch concentrations and therefore have a high AIS percentage.

The accepted procedure for the calculation of AIS is designated as "Solids (Alcohol-Insoluble) in Frozen Peas, Gravimetric Method", 32.065 of the Association of Official Chemists. In addition to the AIS test, an instrument known as a Tenderometer, available from the FMC Corporation of Summit, Ill., is used to provide an initial rough estimation of the quality of a batch of peas based upon the relative tenderness of the peas.

As sugar is converted by the peas into starch, the specific gravity of the peas increases since starch in situ is a more dense compound than sugar. Because of this difference in specific gravity, mature peas have been separated from young, high sugar peas by formulating a brine solution of intermediate specific gravity calculated from data obtained by the AIS test and the use of the Tenderometer. The peas are dispersed into the static brine solution and the more mature peas with a high starch concentration and specific gravity in a high range tend to sink to the bottom of the brine solution. Younger, higher sugar content peas with a low starch concentration and specific gravity in a low range tend to float.

The use of a brine solution having a sodium chloride concentration of at least about thirteen weight percent poses problems. One of these problems includes corrosion of equipment contacted with the brine. The high salt concentration can cause metals within the pea separator to corrode which may effect the taste of the peas. In addition, there is a great problem of disposing of the brine solution after it has been used. Waste brine has a prohibitively high concentration of chloride ions in that environmental regulations make the waste brine difficult or impossible to discharge in some states.

The Adams et al. patent, U.S. Pat. No. 5,039,534, describes an apparatus and a method for separating peas based upon differences in pea specific gravity. The apparatus includes a flow trough having a flow manifold and a series of vanes to distribute water to create a laminar flow within the trough. Peas entering the trough are carried off and classified by settling velocity in the laminar flow region. The settling velocity is dependent upon both specific gravity and pea particle size. Peas having a high settling velocity settle into a first collection chamber. Peas having a lower settling velocity settle into a second collecting chamber.

SUMMARY OF THE INVENTION

The present invention includes a process for separating food particles having at least two ranges of specific gravity. The method includes providing a feedstock of food particles of the two ranges. Next, a slurry of diatomaceous earth and water is provided that has a specific gravity effective for causing food particles of one range of specific gravity to float and the food particles of the other range of specific gravity to sink. The food particles are then added to the slurry and floating food particles are separated from sinking food particles. The separated food particles are then separated from the slurry and are washed with wash water. The wash water and the waste slurry are collected. The diatomaceous earth is removed from the wash water and the slurry for recycle.

DETAILED DESCRIPTION OF THE PREFERRED EMBODIMENTS

Figure 1:
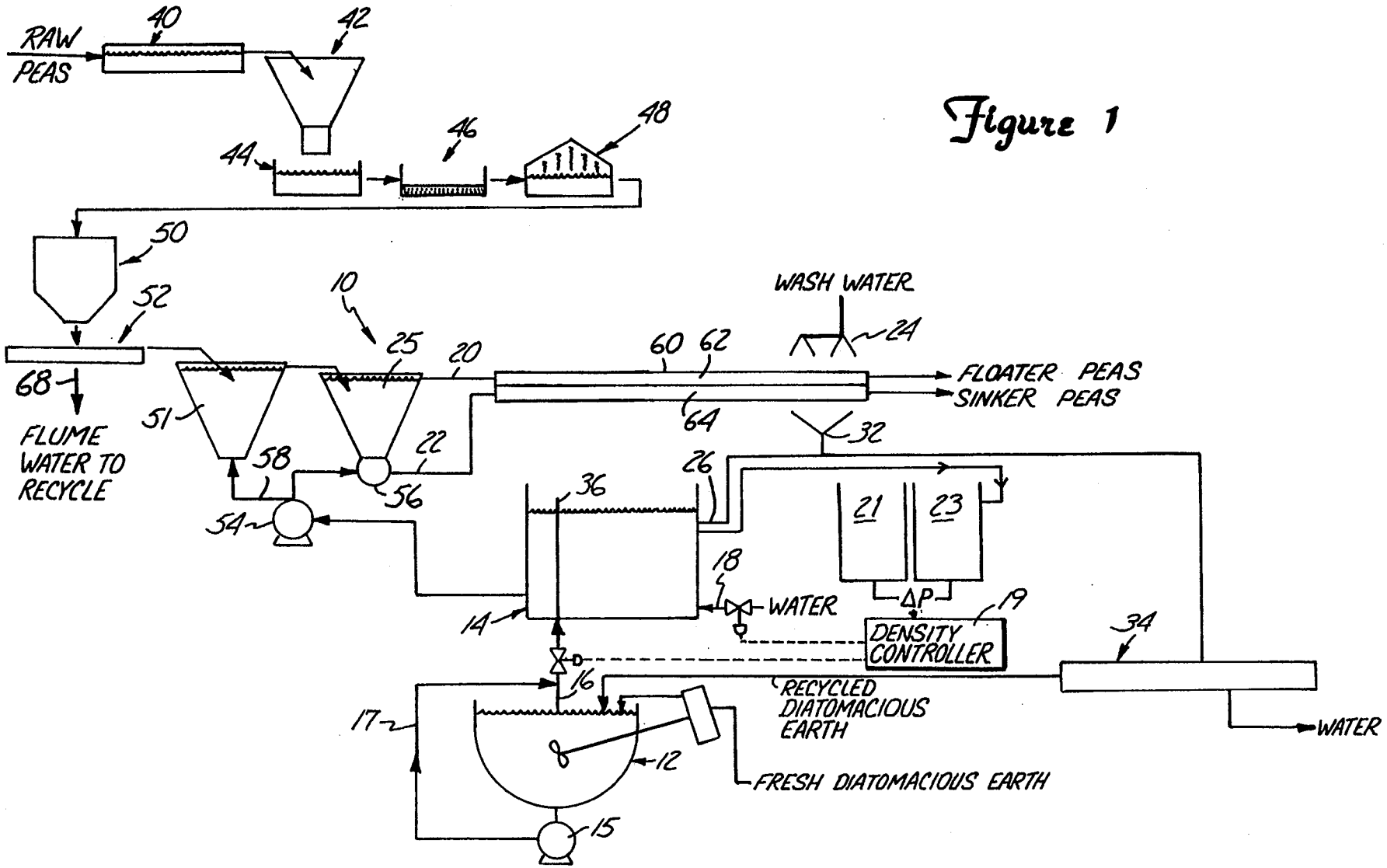
FIG. 1 is a schematic view of one embodiment of the process separating food particles of the present invention.

A process for separating new peas from mature peas of the present invention, illustrated schematically at 10 in FIG. 1, includes providing a slurry of water and diatomaceous earth of a specific gravity effective to float new peas and to sink mature peas, adding a feedstock of peas to the slurry so that the peas either float or sink, separating the floating peas from the sinking peas, dewatering the floating peas and the sinking peas, and recovering the diatomaceous earth from the slurry. The water, now free of the diatomaceous earth, is disposable as desired.

The process of the present invention is a great improvement over the use of a sodium chloride, that is, brine, to separate new peas from mature peas. Brine solutions have posed formidable problems with respect to disposal because of their high chloride concentration. The use of a slurry that includes diatomaceous earth eliminates the problem of disposal because the diatomaceous earth is merely separated front the water once the slurry has been used. Once separated, the water may be safely discharged without detrimentally perturbing the environment. The diatomaceous earth may be reused in the process. The diatomaceous earth has a chemical composition of predominantly silica that makes any eventual disposal much easier than sodium chloride.

The process of the present invention is also an improvement over methods relying on laminar flow to separate new peas from mature peas. The methods relying on laminar flow require expensive equipment and a very narrow flowrate operating range that is difficult to maintain. The process of the present invention does not require expensive equipment and is not dependent upon maintaining a narrow operating flowrate range. Also, the process of the present invention is a true density separation and does not depend upon particle size.

Furthermore, the process of the present invention has applications in separation a variety of food particles. In addition to separating new peas from mature peas, the process is usable to separate edible potatoes from decaying, inedible potatoes. The potato separation is also based upon a difference in specific gravity between the edible and inedible potatoes.

Diatomaceous earth used in the slurry is an unconsolidated, porous, low density sediment made up almost entirely of the opaline silicone remains of diatoms obtained from fresh water fossil formations and marine deposits. Particle size of the diatomaceous earth has an important impact upon the success of the separation process and upon the recovery of the diatomaceous earth. In particular, it has been found that as particle size increases, the agitation required to keep the particles in suspension increases. However, particles that are too small tend to be difficult to get into suspension.

Preferably, the diatomaceous earth used in the process of the present invention includes a particle size range requiring a minimum agitation to remain suspended with a minimum effort to form the suspension. One preferred diatomaceous earth product includes Celatom MN-8®, manufactured by Eagle-Picher Minerals, Inc. of Reno, Nev. The Celatom MN-8® includes physical properties listed in Table 1. A mean particle size diameter of 13.8 microns is preferred for minimal agitation of the slurry.

TABLE 1

| Property | Concentration |
|---|---|
| Free Moisture, % Water | 4.5 |
| Specific Gravity | 2.0 |
| Refractive Index | 1.46 |
| pH, 10% Slurry | 8.3 |
| Plus 325 Mesh (Tyler), % | 8.6 |
| Wet Bulk Density, lbs./cu. ft. | 25 |
| Oil Absorption (Gardner-Coleman), lbs/100 lb | 180 |
| Water Absorption, lbs/100 lbs. | 200 |
| Dry Bulk Density, lbs/cu. ft. | 13 |
| Median Particle Diameter, microns | 13.8 |

The Celatom MN-8® includes a typical chemical analysis that is described in Table 2.

TABLE 2

| Chemical | Concentration (%) |
|---|---|
| Silica | 89.2 |
| Alumina | 4.0 |
| Ferric Oxide | 1.5 |
| Calcium Oxide | 0.5 |
| Magnesium Oxide | 0.3 |
| Other Oxides | 0.5 |
| Loss on Ignition | 4.0 |

The slurry of diatomaceous earth and water is most preferably prepared in a mixing tank such as is illustrated schematically at 12 in FIG. 1. The mixing tank 12 is charged with water and with diatomaceous earth to make the slurry. The diatomaceous earth is either new earth or recycled earth previously used in the food separation process. The water used is preferably a potable water. The diatomaceous earth is added to water to make a slurry having a specific gravity that is between the specific gravity of the new peas and the mature peas.

The concentration of diatomaceous earth added to the water to make the slurry is determined by measuring the Alcohol Insoluble Solids (AIS) of a cross section of peas. The tenderness of the cross section of peas, measured in a Tenderometer, is also used to determine slurry concentration.

The AIS and the pea tenderness are measured periodically, during the separation process, when a sample of peas is periodically collected and tested. The sample of peas is introduced into a near infrared reflectance (NIR) analyzer, such as the InfraAnalyzer available from Bran+Lubbe Analyzing Technologies, Inc. of Spring, Tex. The near infrared analyzer directs light against the sample of peas and determines the absorbance value of the sample of peas at various wavelengths. These absorbance values are fed into a microprocessor, which plugs the absorbance values into a linear equation formulated by the statistical analysis of AIS values from prior batches of peas from previous harvests. The linear equation produces a new AIS value. The slurry specific gravity is then adjusted in accordance with this new AIS value to accommodate starch concentration fluctuations within a run of peas currently being separated.

The absorbance values obtained from the retesting of the sample of peas are used by the microprocessor to adjust the linear equation. In addition, traditional wet chemistry AIS tests are run on the sample of peas to check the AIS value obtained from the near infrared analyzer and microprocessor.

Once the desired amount of diatomaceous earth is added to water to make the slurry, the slurry is agitated in the mixing tank 12 to prevent particles of diatomaceous earth from settling in the tank 12. The slurry is agitated by any conventional mixer including a paddle-type mixer.

Once mixed in the mixing tank 12, the slurry is transferred to a slurry supply tank 14. In one embodiment, the slurry is transferred through a transfer conduit 17 conjoined with the mixing tank 12 and the slurry supply tank 14. The slurry is transferred with a pump 15. Any excess volume of the slurry that is transferred to the slurry supply tank 14 is transferred back to the mixing tank 12 by a return line 16.

The volume of slurry in the slurry supply tank 14 is measured by a level indicator 36. The volume is preferably regulated by a feedback level controller (not shown) in communication with the level indicator that controls the flow of slurry from the mixing tank 12 to the slurry supply tank 14.

In addition to the feed conduit 17 transferring the diatomaceous earth slurry from the mixing tank 12 to the slurry supply tank 14, the slurry supply tank 14 is conjoined with a water feed line 18. The water feed line 18 provides water to the slurry supply tank 14 in order to dilute the slurry with water thereby reducing the specific gravity of the slurry to which the peas are exposed, as needed.

Preferably, the specific gravity of the slurry in the slurry supply tank 14 is measured automatically and is adjusted by feedback control by a specific gravity controller 19. In one embodiment, the specific gravity is measured indirectly by a differential pressure. The differential pressure is directly related to the weight of liquid in two storage columns. A first storage column 21 holds a measured volume of substantially pure water. A second storage column 23 holds a measured volume of a sample of slurry obtained from the slurry supply tank 14. The specific gravity of the slurry is the quotient of the weight of the slurry and the weight of the pure water at a particular temperature. The specific gravity measurements are relayed to the specific gravity controller 19. The controller 19 adjusts either the flow of slurry into the slurry supply tank 14 or flow of water through line 18 into the slurry supply tank 14, as needed, to maintain a target specific gravity for slurry in the slurry supply tank 14.

The temperature of the diatomaceous earth slurry in the slurry supply tank 14 is most preferably about 90 degrees Fahrenheit. A slurry of lower temperature will not adequately separate new peas from mature peas. A slurry of higher temperature will be detrimental to pea texture.

From the slurry supply tank 14, slurry is transferred by a pump 54 to a settling chamber 25. In one embodiment, the settling chamber 25 has a generally conical shape and includes a rounded bottom portion 56 for capturing peas. The slurry is also transferred by the pump 54 to a contact chamber 51. Preferably, the slurry is added to the contact chamber 51 from a line 58 positioned near the bottom of the chamber 51.

In one embodiment, a feedstock of new peas and mature peas is added to the contact chamber 51 at a rate of about 10,000 to 15,000 pounds per hour. In the contact chamber 51, the peas are contacted with slurry for the first time. The weight of the feedstock added to the contact chamber 51 includes surface moisture of the new peas and the mature peas as well as the weight of the peas themselves.

Prior to contacting the slurry, the peas are preferably delivered to a precleaner 40 for an initial cleaning. Next, the peas are transferred to a surge hopper 42 and then to a froth washer 44. From the froth washer 44, the peas are graded by size via a size grader 46 and then are blanched using a blancher 48. The blancher 48 removes air from the peas. Air within the peas interferes with the rate at which the "sinker" peas descend in the settling chamber 25. Peas from the blancher 48 are delivered to a hopper 50 which feeds the peas onto a dewatering belt 52. While on the dewatering belt, water 68 from the blanching step is removed from the peas. The water 68 may be either recycled or discharged. Once the peas are dewatered on the dewatering belt 52, the peas are transferred by the belt 52 to the slurry in the contact chamber 51.

Once disposed in the slurry, the peas and slurry are transferred to the settling chamber 25. Because the slurry is added to the contact chamber 51 near the bottom of the chamber 5 I, the slurry flow aids in flushing the peas through the contact tank 51 so that peas do not accumulate in the contact chamber 51. In the settling chamber 25, the peas separate into one of two groups, peas that float or "floaters", and peas that sink or "sinkers". The "sinker" peas, having a high starch content, are denser than the diatomaceous earth slurry and settle in the rounded bottom portion 56 of the settling chamber 25. The "sinker" peas are transferred out of the settling chamber 25 through a conduit 22 conjoined with the bottom portion 56 of the settling chamber 25 once the peas have descended in the settling chamber 25.

Peas having a low starch content tend to float at or near the surface of the slurry. The "floater" peas are transferred out of the settling chamber 25 through a conduit 20 positioned just below the surface of the slurry.

In one preferred embodiment that is not shown, the slurry is transferred to one of six settling chambers. This embodiment preferably includes a single slurry supply tank 14.

The high starch "sinker" peas and the low starch "floater" peas are delivered by the conduits 22 and 20, respectively, to a dewatering belt 60 for dewatering. The dewatering belt 60 includes a first belt member 62 for transferring and dewatering floater peas and a second belt member 64 for transferring and dewatering sinker peas. In one embodiment, the dewatering belt 60 is positioned over the slurry supply tank 14 so that slurry may drain from the peas into the tank 14.

While on the dewatering belt 60, both the floater pea stream on the first belt member 62 and the sinker pea stream on the second belt member 64 are subjected to a spray wash 24 and to a flume water rinse (not shown) while being dewatered. The wash water 24 is collected at a collection point 32, such as a trough. The washing and rinsing of the peas removes diatomaceous earth that adheres to the surface of the peas.

About two to four pounds of spray wash water for each pound of peas are required to remove substantially all of the diatomaceous earth from the surface of the peas. In one preferred embodiment, the washing is performed in stages to minimize water quantity requirements.

The steps of dewatering, washing and rinsing the streams of floater peas and sinker peas produce waste streams including used slurry. The waste streams including used slurry include an overflow stream 26 from the slurry supply tank 14 and wash water 24 from each of the floater and sinker streams. The wash water stream 24 and slurry overflow stream 26 are transferred to a belt filter 34. At the belt filter 34, the diatomaceous earth is separated from the water component of the slurry. The water is then discharged or recycled as desired.

Once separated and washed, the high starch "sinker" peas and the low starch "floater" peas are taken away from the pea separation process. In one embodiment, the peas are transferred from the dewatering belt 60 to a flume (not shown) having two channels. Floater peas are transferred to one of the channels and sinker peas are transferred to the other channel. The separated peas may be canned or frozen or used in another food product.

The diatomaceous earth which is collected from the belt filter 34 is added to the mixing tank 12 for preparing make-up diatomaceous earth slurry to the separator 14. Fresh diatomaceous earth is added as required to prepare a slurry of the appropriate density.

In one embodiment, the diatomaceous earth is sterilized prior to being reused in the pea separation process. The diatomaceous earth is sterilized in order to kill any microbes growing in slime trapped between the diatomaceous earth particles. The slime is transferred from the peas to the diatomaceous earth during the separation, washing and rinsing steps. The diatomaceous earth is sterilized when it is desired to recover substantially all of the diatomaceous earth.

Although the present invention has been described with reference to preferred embodiments, workers skilled in the art will recognize that changes may be made in form and detail without departing from the spirit and scope of the invention.

What is claimed is:

1. A process for separating food particles based on specific gravity, comprising:

providing a feedstock of the food particles that have been precleaned and blanched;

providing a slurry of diatomaceous earth and water having a selected specific gravity effective for particles of a lower specific gravity to float in the slurry and for particles of a higher specific gravity to sink;

adding the feedstock of the food particles to the slurry; and separating the particles of the higher specific gravity from the particles of the lower specific gravity.

2. The process of claim 1 and further including washing the food particles with wash water and collecting the wash water.

3. The process of claim 1 and further including dewatering the food particles and collecting the water.

4. The process of claim 3 and further including removing the diatomaceous earth from the water collected.

5. The process of claim 4 and further including reusing the diatomaceous earth in the process.

6. A process for separating young peas from mature peas comprising:

providing a feedstock of young peas and mature peas;

providing a slurry of diatomaceous earth and water having a density effective for young peas to float in the slurry and mature peas to sink:

adding the feedstock of peas to the slurry to make a suspension of floating peas and sinking peas; and separating the floating peas from the sinking pea.

7. The process of claim 6 and further including washing the peas and collecting the wash water.

8. The process of claim 6 and further including dewatering the peas and collecting the water.

9. The process of claim 7 and further including removing the diatomaceous earth from the water collected.

10. The process of claim 8 and further including removing the diatomaceous earth from the water collected.

11. The process of claim 6 and further including reusing the diatomaceous earth in the process.

* * * * *